United States Patent [19]

Peill

[11] 4,135,855

[45] Jan. 23, 1979

[54] HOLLOW COOLED BLADE OR VANE FOR A GAS TURBINE ENGINE

[75] Inventor: Peter G. Peill, Hamilton, Canada

[73] Assignee: Rolls-Royce Limited, London, England

[21] Appl. No.: 511,520

[22] Filed: Oct. 2, 1974

[30] Foreign Application Priority Data

Oct. 13, 1973 [GB] United Kingdom ..... 47917/73

[51] Int. Cl.[2] ..... F01D 5/18

[52] U.S. Cl. ..... 416/90 R; 415/115

[58] Field of Search ..... 416/90, 96, 97, 95, 416/232, 233; 415/115

[56] References Cited

U.S. PATENT DOCUMENTS

| | | | |
|---|---|---|---|
| 3,528,751 | 9/1970 | Quinones et al. | 416/233 |
| 3,799,696 | 4/1974 | Reedman | 416/97 |

*Primary Examiner*—Samuel Feinberg

*Attorney, Agent, or Firm*—Cushman, Darby & Cushman

[57] ABSTRACT

A hollow cooled blade or vane for a gas turbine engine is provided with cooling on certain areas of its interior surface by an impingement plate which is supported from and sealed to the blade interior by a pair of ribs.

8 Claims, 3 Drawing Figures

HOLLOW COOLED BLADE OR VANE FOR A GAS TURBINE ENGINE

This invention relates to a hollow cooled blade or vane for a gas turbine engine.

It is sometimes necessary for blades to be provided with areas of particularly effective cooling; this may occur at hot areas such as the nose of the blade or at hot spots caused by the flow round the blade. One known way of providing effective cooling is the so-called 'impingement' cooling, in which jets of air are directed at the inner surface of the blade in the areas to be cooled.

The present invention provides a construction which enables impingement cooling to be simply provided at selected areas of the blade.

According to the present invention a hollow cooled blade or vane for a gas turbine engine comprises an interior surface having a pair of inwardly extending ribs between which extends an apertured plate spaced from the interior surface and sealed to the blade interior at the ribs.

There may be more than one said pair of ribs and plate to provide specific cooling in more than one locality.

Preferably each said rib is provided with a groove within which said plate engages; one rib may be used to mount two said plates by providing two said grooves in it.

The impingement cooling provided in this manner may form only part of the cooling of the blade, the remainder of the blade being cooled by any suitable expedient.

Sealing means are preferably provided to seal the ends of said plates.

Preferably said ribs extend in a spanwise direction of the blade.

Figure 1:
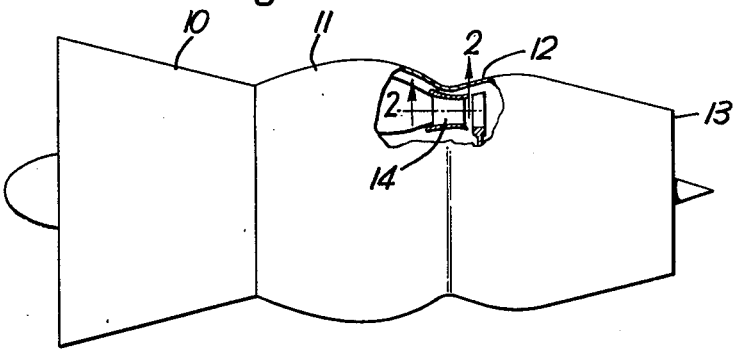
Figure 2:
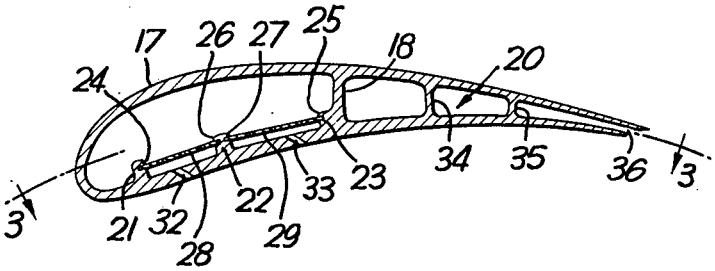
Figure 3:
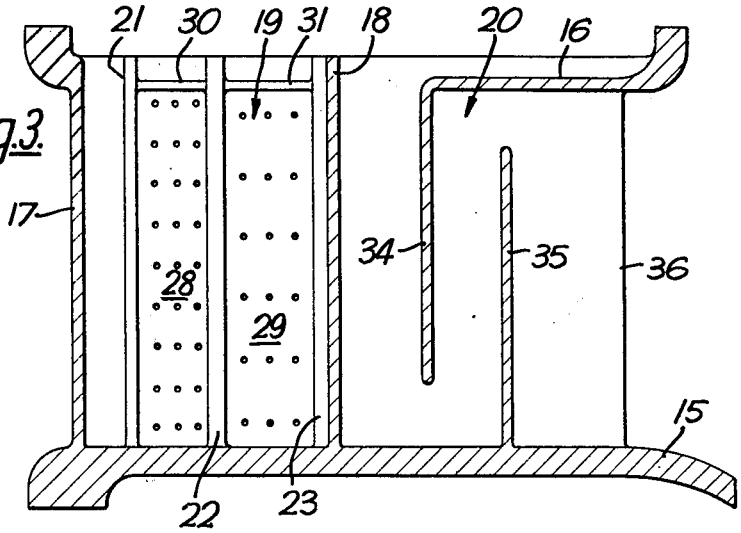

The invention will now be particularly described with reference to the accompanying drawings in which:

FIG. 1 is a partly broken-away view of a gas turbine engine incorporating a blade in accordance with the invention, FIG. 2 is an enlarged section on the line 2—2 of FIG. 1, and FIG. 3 is a cross-section on the line 3—3 of FIG. 2.

In FIG. 1 there is shown a gas turbine engine comprising a compressor section 10, combustion section 11, turbine section 12 and final nozzle 13, all in flow series. The casing of the engine is broken away at the downstream end of the combustion section to show the nozzle guide vanes 14 which are mounted at the end of the combustion chamber.

The guide vanes are shown in greater detail in FIGS. 1 and 3 which are transverse and longitudinal sectional views respectively. Referring first to FIG. 3 the vane comprises inner and outer platforms 15 and 16 and an aerofoil portion 17. The aerofoil portion 17 is hollow and is provided with a transverse division 18 which divides the aerofoil portion into a forward section 19 and rearward section 20.

In the wall of the forward section 19 are formed three spanwise extending ribs 21, 22 and 23, the ribs 21 and 23 being provided with inwardly facing spanwise grooves 24 and 25 while the rib 22 has two spanwise grooves 26 and 27 which face the grooves 24 and 25 respectively. Slotted into these grooves, and sealing with the ribs, are apertured plates, a forward plate 28 which engages with the grooves 24 and 26 and a rearward plate 29 which engages with the grooves 25 and 27.

The plates 28 and 29 also engage with and seal against the inner platform 15, while they are provided with further sealing ribs 30 and 31 at their extremities adjacent the outer platform 16; in this way the only access to the space between the plates and the inside surface of the vane from the vane interior is through the apertures in the plates. If necessary, further spacing ribs may be provided to support the central areas of the plates. Film cooling holes 32 and 33 are provided which pass from the space between the plates and the vane interior surface to the outer surface of the vane.

Operation of the cooling system for the forward part of the vane is as follows:

Air is fed to the upper surface of the platform 16 from a source of high pressure air, which would normally comprise a feed from some part of the compressor. It then flows into the forward section 19, and passes through the apertures in the plates 28 and 29 in the form of jets which impinge on the inner surface of the vane to provide impingement cooling of those parts of the vane. The air then flows through the film cooling holes 32 and 33 to provide film cooling of the concave flank of the vane.

It will therefore be seen that the construction in accordance with the invention enables a specific area of the vane (i.e. that area between the ribs 21, 22 and 23) to be provided with efficient cooling from a single structure. The cooling system of the remaining portion of the vane, although not strictly relevant to the invention, comprises a sinuous passage formed by the division 18 and further walls 34 and 35 which extend from the platforms 16 and 15 respectively and extend to just short of the opposite platforms. The air entering between the division 18 and wall 34 flows through the sinuous passage thus formed, cooling the rearward portion, and leads the vane through a trailing edge slot 36.

It will be appreciated that this is only one of a number of possible ways of cooling the trailing section of the vane; it could be cooled for instance by impingement, film cooling, flow through obstructed or sinuous passages or combinations of these.

It will also be noted that in the embodiment described, three ribs were used to mount two apertured plates. However, it will be understood that two ribs are necessary for one plate, and multiples of two could be used if desired. Using one rib for two adjacent plates as described above may be better in some circumstances, and the same principle could be applied to larger numbers of plates. Again, it will be understood that the principle could be applied to smaller areas than the complete strips of the vane embodied above; these areas could of course be located anywhere on the internal surface of the vane.

I claim:

1. A hollow cooled blade or vane for a gas turbine engine comprising a skin having an interior surface on which are formed a pair of ribs, each rib having a groove therein, an apertured plate having edges engaged in the grooves of said ribs and extending between the ribs and spaced from the interior surface of the blade and sealed to the interior surface at the ribs, and cooling fluid supply means adapted to cause cooling fluid to flow through the apertures to impingement cool the interior surface.

2. A hollow cooled blade or vane as claimed in claim 1 and in which film cooling holes are formed in the skin of the vane passing from the space between the plate and the interior surface of the exterior surface of the vane.

3. A hollow cooled blade or vane as claimed in claim 1 and in which there are two adjacent ribs provided with facing grooves, said plate being mounted in the facing grooves.

4. A hollow cooled blade or vane as claimed in claim 1 and in which one said rib is provided with two said grooves within which one edge of each of two said plates are mounted.

5. A hollow cooled blade or vane as claimed in claim 1 and in which more than one said pair of ribs and plate are provided to enable cooling in more than one specific locality.

6. A hollow cooled blade or vane as claimed in claim 1 and in which said ribs extend in a spanwise direction of the blade or vane.

7. A hollow cooled blade or vane as claimed in claim 1 and in which further sealing means are provided to seal the ends of the plate to the interior surface.

8. A hollow cooled blade or vane as claimed in claim 1 and in which further cooling means are provided to cool those parts of the blade or vane not cooled through the apertured plates.

* * * * *